United States Patent [19]

White et al.

[11] Patent Number: 4,848,078

[45] Date of Patent: Jul. 18, 1989

[54] FLYER FOR TEXTILE APPARATUS

[76] Inventors: Frances H. White; Eugene F. White, both of 310 Macedonia Church Rd., Monroe, N.C. 28110

[21] Appl. No.: 215,286

[22] Filed: Jul. 5, 1988

[51] Int. Cl.[4] ..... D01H 7/86; D01H 7/26; D01H 13/10; B65H 57/20

[52] U.S. Cl. ..... 57/352; 57/58.83; 57/58.86; 57/59; 57/68; 242/128; 242/155 M

[58] Field of Search ..... 57/352, 58.49–3, 57/58.83–6, 59, 67, 68, 71; 242/128, 155 M, 147 M

[56] References Cited

U.S. PATENT DOCUMENTS

| | | | |
|---|---|---|---|
| 3,044,246 | 7/1962 | Schippers | 57/58.52 |
| 3,133,403 | 5/1964 | Lenk | 57/58.86 |
| 4,121,410 | 10/1978 | Bosman | 57/58.63 |
| 4,165,599 | 8/1979 | Lenorak | 57/58.83 |
| 4,237,683 | 12/1980 | Mathiolon et al. | 57/58.86 |
| 4,423,587 | 1/1984 | Inoue | 57/58.86 |
| 4,641,493 | 2/1987 | Fukunaga | 57/58.83 X |
| 4,754,599 | 7/1988 | Siebert | 57/58.52 |
| 4,769,980 | 9/1988 | Siebert | 57/58.52 |

*Primary Examiner*—John Petrakes

*Attorney, Agent, or Firm*—Daniel E. McConnell

[57] ABSTRACT

A textile apparatus is disclosed wherein a cylindrical package of strand material is mounted on an elongated hollow spindle and the strand material is withdrawn from the package and through the hollow spindle for further processing. A flyer arm is mounted on an extremity of the spindle for rotation thereabout with the arm extending radially outwardly of the spindle to overlie the outer circumference of the package. An adjustable strand tensioning device is mounted on the flyer adjacent the longitudinal axis of the spindle and longitudinally spaced from the end of the spindle and within an envelope defined by the path of movement of the strand material as it is guided by the flyer arm from the package into the hollow spindle.

9 Claims, 2 Drawing Sheets

FLYER FOR TEXTILE APPARATUS

FIELD AND BACKGROUND OF INVENTION

This invention relates to a flyer for textile apparatus and particularly to a low inertia flyer for apparatus of the type in which a strand material is drawn from a generally cylindrical package and passed through a hollow spindle on which the package is supported.

Certain textile processes such as twisting and winding are done with apparatus in which strand material or yarn is brought to the process in a wound package such as a cone, mounted on a hollow spindle, and then drawn from the package and through the hollow spindle for further processing. Persons skilled in the textile arts will be familiar with such apparatus and processes and will be able to identify appropriate applications for the invention described hereinafter without necessity or more detailed description here of such apparatus and processes.

Many such apparatus have included flyers in the form of arms mounted for rotation about spindles mounting strand material packages, and guiding strand material as it is drawn from the packages. Certain such apparatus have provided tension control means associated with flyers for controlling the tensioning of strand materials moving through flyers. Such apparatus have presented at least two major types of problems.

One problem arises out of the inertial effects of the rotating mass of the flyer. As will be understood, a flyer with a relatively great mass will be slower to accelerate and decelerate and will impose stress on the strand material which must transmit the forces necessary to accomplish such changes in momentum or overfeed strand material during deceleration. Thus it is desirable to have minimal inertial mass for a flyer.

Another problem arises out of the use of a tensioning device to impose tension on strand material moving through the flyer. Where such devices are used, greater control over the strand material is accomplished, as is necessary for certain processes. However, the inertial mass of the flyer is increased while difficulties are introduced in setting, controlling and operating the tensioning device. Certain prior proposals have addressed at least some of these problems by embedding the tensioning device within the hollow spindle, at the cost of significantly complicating the setting, controlling and maintenance of the tensioning device.

BRIEF DESCRIPTION OF INVENTION

With the foregoing in mind, it is an object of this invention to provide a low inertial mass flyer for a textile apparatus which avoids the problems created by prior devices. In realizing this object of this invention, a particular arrangement of a flyer arm and a tensioning device is proposed in which the tensioning device is mounted in an accessible position while minimizing the contribution of the tensioning device to any increase in the moment of inertia of the flyer.

Yet a further object of this invention is to provide a flyer having an associated tensioning device capable of manual, repeatable adjustment of the tension imposed on strand material moving through the flyer. In realizing this object of the present invention, the tensioning device contemplated by this invention is a permanent magnet device requiring no outside energization and capable of accurate and stable adjustment.

Yet a further object of this invention is to accomplish accurate tension control while also accommodating expedited threading of the hollow spindle with strand material. In realizing this object of the invention, the tensioning device contemplated by this invention includes a sheave positioned for entrainment of strand material thereabout and mounted in such a way that a clear passage for air jet threading is maintained.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
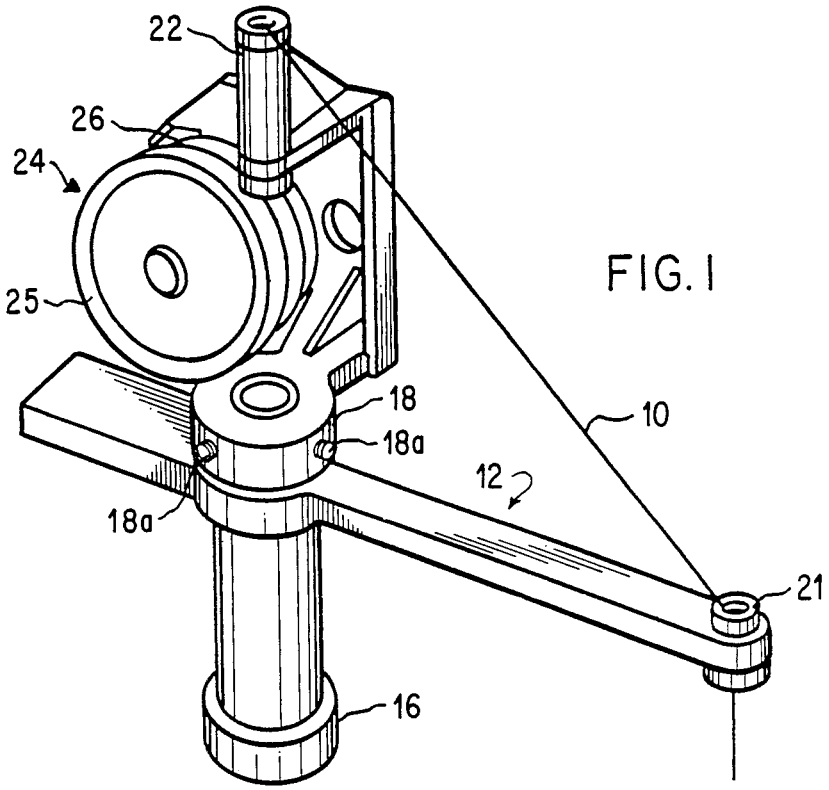
FIG. 1 is a perspective view of a flyer apparatus in accordance with this invention.
Figure 2:
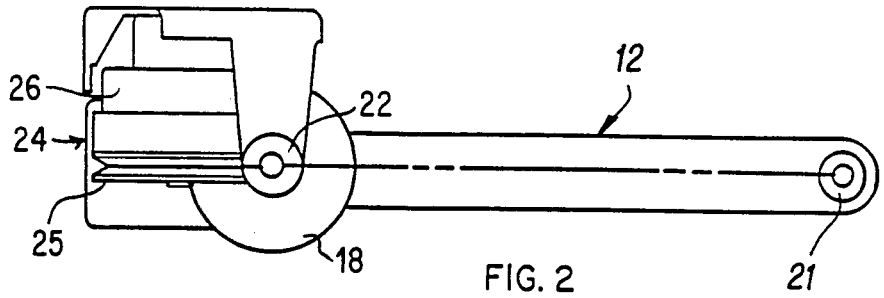
FIG. 2 is a plan view of the flyer apparatus of FIG. 1.
Figure 3:
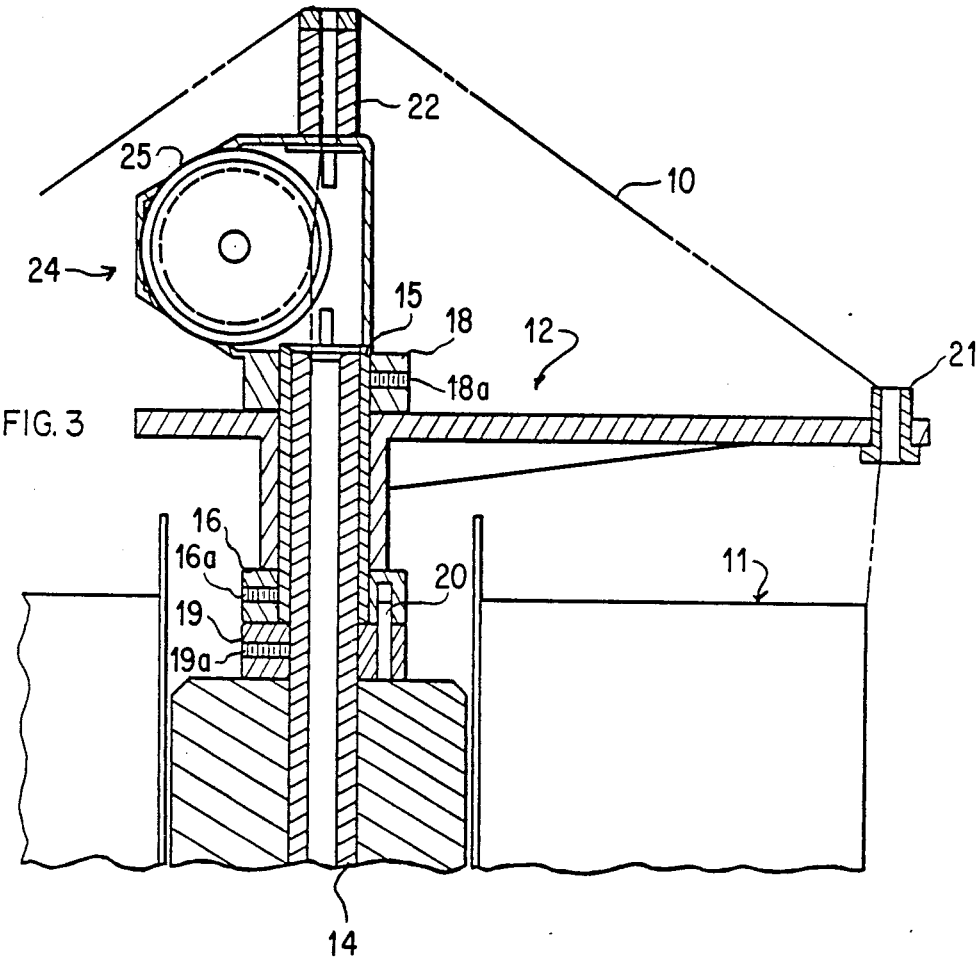
FIG. 3 is an elevation view, in section, of the flyer apparatus of FIGS. 1 and 2 as mounted in a textile apparatus.

Referring now more particularly to the accompanying drawings, the present invention contemplates that an improved apparatus for guiding and tensioning strand material may be supplied for use with a textile apparatus of the type in which strand material indicated at 10 is supplied from a generally cylindrical package 11 (FIG. 3) and is drawn from the package for further processing by instrumentalities which are not shown and which may take the forms shown in a number of prior disclosures to which the interested reader is referred. The strand material 10 is engaged and guided by a flyer arm means generally indicated at 12 as it moves to and through an elongate hollow spindle 14 on which the package 11 is supported. The flyer arm 12 is mounted on an extremity of the hollow spindle 14 for rotation about the axis of the spindle. In the form shown, the flyer arm is mounted on a sleeve 15 between a pair of annular locking shoulders 16, 18. The lower one 16 of these locking shoulders rests upon a third annular locking shoulder 19 and is coupled therewith by a key member 20. By means of set screws **16*a*, 18*a*, 19*a*, the locking shoulders are fixed against rotation relative to the spindle 14 and sleeve 15**.

In order to achieve low moment of inertia for the flyer arm means 12, it is preferred that the arm be made of a lightweight material such as a molded plastic and that the cross section of the arm be selected as some form which imparts the necessary strength while adding minimal mass. In order to improve wear life, the arm may be provided with an eyelet guide 21 at the free end, through which the strand material 10 moves. The arm extends radially outwardly of the spindle 14 to overlie the outer circumference of a package 11 mounted on the spindle 14. The arm also has a rotating counterweight portion directed oppositely from the eyelet 21 for purposes of balance.

For purposes to be made more clear hereinafter, the apparatus according to this invention has end guide means 22 coaxially aligned with the hollow spindle 14 and spaced from the extremity thereof by a predetermined distance. The end guide 22 cooperates with the eyelet 21 in guiding strand material 10 to define an envelope (indicated by dashed lines in FIG. 3) as the arm rotates and strand material is advanced.

In accordance with an important feature of this invention, the apparatus contemplated has an adjustable tensioning means, generally indicated at 24, mounted adjacent the flyer arm 12 for imposing controlled tension on strand material being guided by the flyer arm. The tensioning means is stationarily mounted adjacent the longitudinal axis of said spindle for minimizing the inertial effects of the mass rotating with the flyer arm and mounted in longitudinally spaced relation from the adjacent extremity of the spindle and within the envelope defined by the path of movement of the strand material as the same is guided by the flyer arm 12 from the package 12 into the hollow spindle 14. The tensioning means 24 comprises a rotatable strand engaging guide 25 mounted for rotation about an axis perpendicular to the longitudinal axis of the spindle 14 for entrainment of the strand material thereabout and for being driven in rotation by the engaged strand, and drag means operatively associated with the rotatable guide for imposing thereon a controlled force resisting rotation of the guide as strand material entrained thereabout is drawn into the spindle. Preferably, the rotating guide is a sheave having a gripping characteristic for securely engaging strand material wrapped thereabout. Preferably, the drag means takes the form of a permanent magnet brake means 26 operatively coupled with the sheave for imposing thereon a braking force resisting rotation thereof and thereby for exerting tensioning force on the engaged strand material. The permanent magnet brake may take the specific forms of a permanent magnet hysteresis brake or a permanent magnet magnetic particle brake. In either instance, the brake device may be easily adjusted to predetermined drag forces, which are then consistently maintained and resettable.

In addition to the characteristics described hereinabove, the present invention contemplates that threading of the textile machine equipped with the apparatus of this invention may be facilitated by certain relationships among the elements described to this point. More particularly, the alignment of the end guide 22 with the hollow spindle and the size, spacing and mounting of the rotatable guide or sheave 25 are such that the textile apparatus may be easily threaded by entrainment of the strand material in an air jet directed by an operator to flow through the hollow spindle. Specifically, the sheave 25 has a predetermined radius and is mounted for rotation about center of rotation or axis perpendicular to the longitudinal axis of the spindle 14 and spaced from the longitudinal axis of the spindle by a distance greater than the radius in order to provide a clear pathway for threading of the strand material through the spindle (see FIG. 3).

The apparatus of this invention, having a low inertial mass flyer, is capable of accomodating high speeds of strand material movement while gently lifting strand material from the package and avoiding the scuffing or entanglement of strand material which has been characteristic of certain prior devices. This is accomplished while, at the same time, providing accurate, repeatable control over tension in the strand material by means of the tension control device employed.

In the drawings and specifications there has been set forth a preferred embodiment of the invention and, although specific terms are used, the description thus given uses terminology in a generic and descriptive sense only and not for purposes of limitation.

What is claimed is:

1. In a textile apparatus having an elongate hollow spindle for mounting a generally cylindrical package of strand material and means for drawing strand material from the package through the hollow spindle for further processing, an improved apparatus for guiding and imposing tension on the strand material as it is drawn from the package and advanced for processing and comprising flyer arm means for engaging and guiding strand material as the same is removed from the package and drawn through the hollow spindle, said flyer arm means being mounted on an extremity of the spindle for rotation thereabout and having an arm extending radially outwardly of the spindle to overlie the outer circumference of a package mounted on the spindle, and adjustable tensioning means stationarily mounted on said flyer arm means for imposing controlled tension on strand material being guided by said flyer arm means, said tensioning means being mounted adjacent the longitudinal axis of said spindle and in longitudinally spaced relation from the adjacent extremity of the spindle and within an envelope defined by the path of movement of the strand material as the same is guided by said flyer arm means from the package into the hollow spindle.

2. A textile apparatus according to claim 1 where said tensioning means comprises rotatable strand engaging guide means mounted for rotation about an axis perpendicular to the longitudinal axis of said spindle for entrainment of the strand material thereabout and for being driven in rotation by the engaged strand, and permanent magnet brake means operatively coupled with said rotatable guide means for imposing thereon a braking force resisting rotation thereof and thereby for exerting tensioning force on the engaged strand material.

3. Apparatus according to claim 2 wherein said permanent magnet brake means comprises a permanent magnet hysteresis brake.

4. Apparatus according to claim 2 wherein said permanent magnet brake means comprises a permanent magnet magnetic particle brake.

5. Apparatus according to claim 2 wherein said rotatable guide means comprises sheave means for engaging a strand wrapped thereabout.

6. A textile apparatus according to claim 1 wherein said tensioning means comprises sheave means mounted for rotation about an axis perpendicular to the longitudinal axis of said spindle for entrainment of the strand material thereabout, and drag means operatively associated with said sheave means for imposing thereon a controlled force resisting rotation of said sheave means as strand material entrained thereabout is drawn into the spindle.

7. Textile apparatus according to one of claim 5 or 6 wherein said sheave means has a predetermined radius about a center of rotation and further wherein said sheave means is mounted with said center of rotation spaced from the longitudinal axis of the spindle by a distance greater than said radius in order to provide a clear pathway for threading of the strand material through the spindle.

8. A textile apparatus according to claim 7 wherein said flyer arm means comprises end guide means coaxially aligned with the hollow spindle and spaced from the extremity thereof by a distance greater than said radius in order to provide a clear pathway for threading of the strand material through the spindle and said flyer arms means.

9. In a textile apparatus having an elongate hollow spindle for mounting a generally cylindrical package of strand material and means for drawing strand material from the package through the hollow spindle for further processing, an improved apparatus for guiding and imposing tension on the strand material as it is drawn from the package and advanced for processing and comprising: flyer arm means for engaging and guiding strand material as the same is removed from the package and drawn through the hollow spindle, said flyer arm means being mounted on an extremity of the spindle for rotation thereabout and having an arm extending radially outwardly of the spindle to overlie the outer circumference of a package mounted on the spindle and end guide means coaxially aligned with the hollow spindle and spaced from the extremity thereof by a first predetermined distance; and adjustable tensioning means stationarily mounted adjacent said flyer arm means for imposing controlled tension on strand material being guided by said flyer arm means, said tensioning means being mounted adjacent the longitudinal axis of said spindle and in longitudinally spaced relation from the adjacent extremity of the spindle and within an envelope defined by the path of movement of the strand material as the same is guided by said flyer arm means from the package into the hollow spindle; said tensioning means having sheave means having a predetermined radius less than said first predetermined distance and mounted for rotation about an axis perpendicular to the longitudinal axis of said spindle and spaced therefrom at a distance greater than said radius for entrainment of the strand material thereabout, and permanent magnet brake means operatively coupled with said sheave means for imposing thereon a controlled force resisting rotation of said sheave means as strand material entrained thereabout is drawn into the spindle.

* * * * *